US005819444A

United States Patent [19]

Desmarais

[11] Patent Number: 5,819,444

[45] Date of Patent: Oct. 13, 1998

[54] SNOW BLADE WITH TILTABLE LATERAL PANELS

[76] Inventor: Denis Desmarais, 711, Principale, St-Liguori, Québec, Canada, J0K 2X0

[21] Appl. No.: 878,634

[22] Filed: Jun. 19, 1997

Related U.S. Application Data

[60] Provisional application No. 60/020,132, Jun. 20, 1996.

[51] Int. Cl.[6] ..... E01H 5/06

[52] U.S. Cl. ..... 37/281; 37/234; 172/815; 172/782

[58] Field of Search ..... 37/281, 282, 241, 37/283, 234, 232, 236, 266, 903, 279, 409; 172/815, 816, 828, 782, 786

[56] References Cited

U.S. PATENT DOCUMENTS

| | | | |
|---|---|---|---|
| 3,279,104 | 10/1966 | Wandscheer et al. | 37/281 X |
| 3,424,251 | 1/1969 | Bouley | 172/701 X |
| 3,477,151 | 11/1969 | Zanella | 37/281 |
| 3,807,064 | 4/1974 | Schmidt, Jr. | 37/281 X |
| 4,079,791 | 3/1978 | Yoder et al. | 172/815 |
| 4,099,578 | 7/1978 | Stevens | 172/815 |
| 4,356,645 | 11/1982 | Hine et al. | 37/281 |
| 4,479,312 | 10/1984 | Turgeon | 37/219 |
| 4,552,226 | 11/1985 | Platter | 172/815 |
| 4,723,609 | 2/1988 | Curtis | 172/815 |
| 5,638,618 | 6/1997 | Niemela et al. | 37/281 |

*Primary Examiner*—Tamara L. Graysay
*Assistant Examiner*—Thomas A. Beach
*Attorney, Agent, or Firm*—François Martineau

[57] ABSTRACT

A snow plow composed of a central blade and of two wing blades which are laterally hinged to the end of the main blade for wing blade angular adjustment forwardly and rearwardly of the main blade from a position and alignment with the same. Furthermore, the level of each wing blade with respect to the main blade can be adjusted. Also, tilt motion of the laterally outward end portions of the wing blades either upwardly or downwardly is also possible. Each blade consists of a flat panel and its bottom edge carries a striker lip which can pivot rearwardly during forward movement of the plow upon the blade striking an obstacle. The snow plow is supported by a structure in front of a vehicle having forward lifting and tilting arms, this structure allowing a snow plow to laterally tilt within a limited angle in accordance with the transverse inclination of the surface being plowed. Upon slight rising of the snow plow, its forward pitch angle automatically increases to a predetermined limit.

8 Claims, 7 Drawing Sheets

A
B
4
4
54
2
52
54

A
C
B
2
52
4
54

Fig. 6
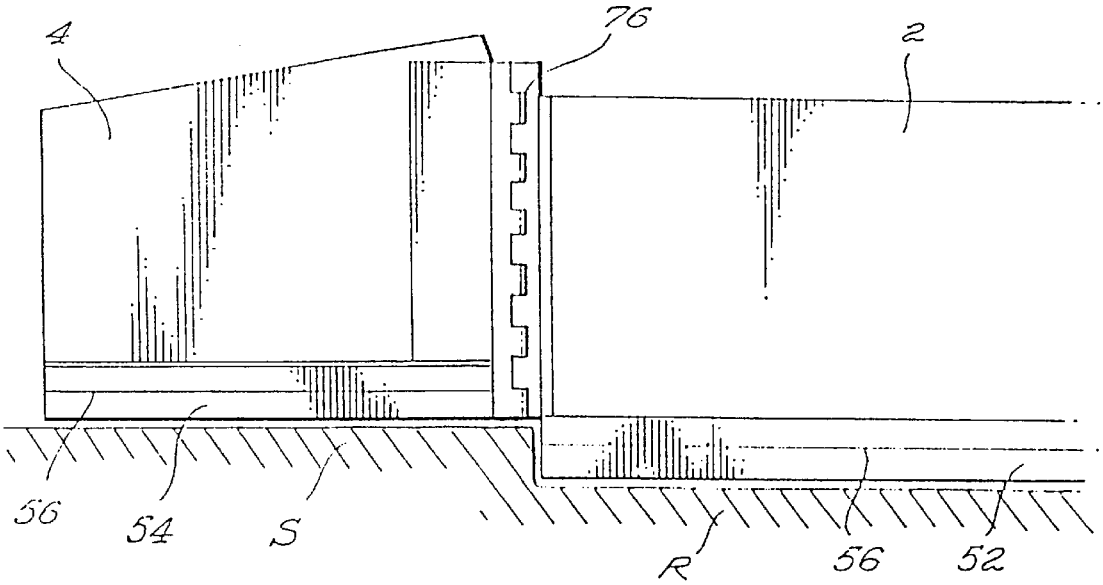
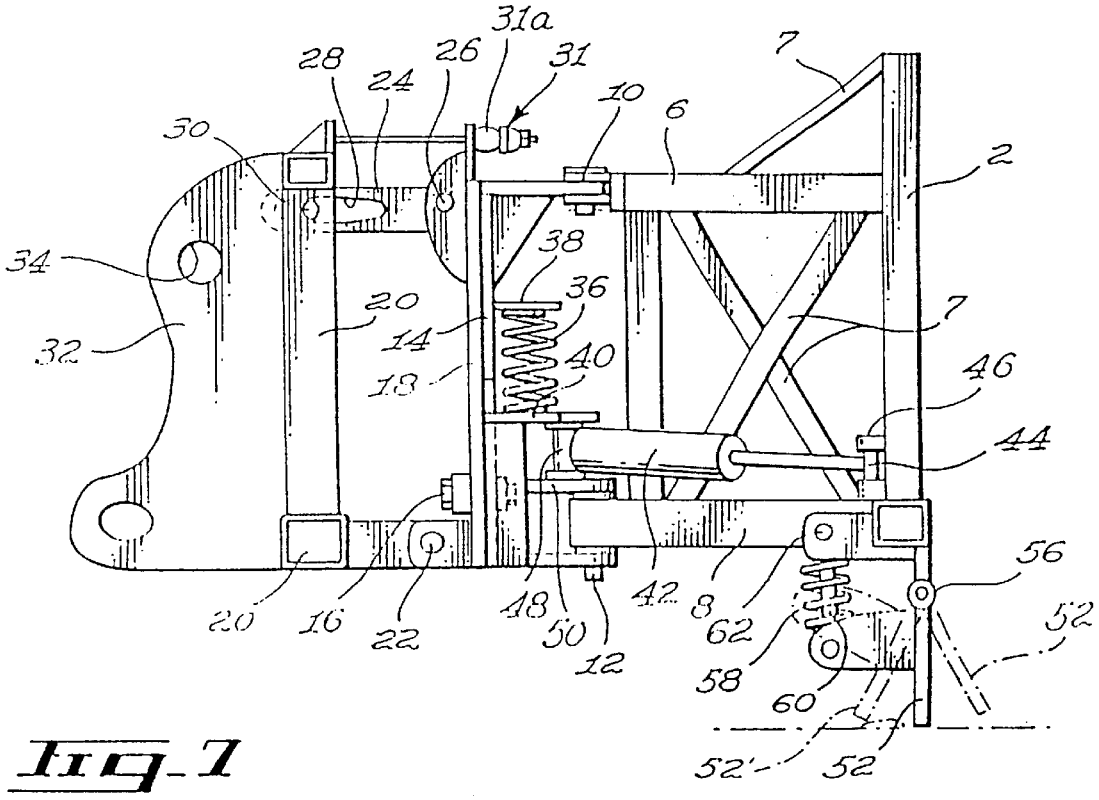
Fig. 7

Fig. 12
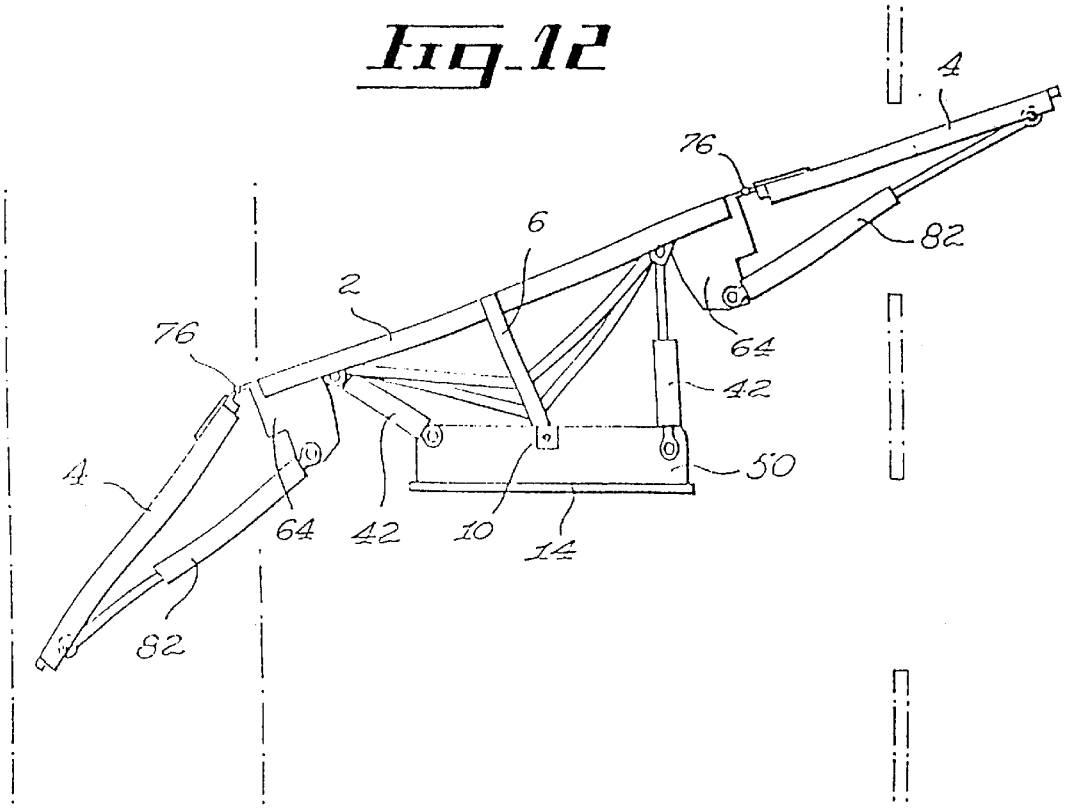
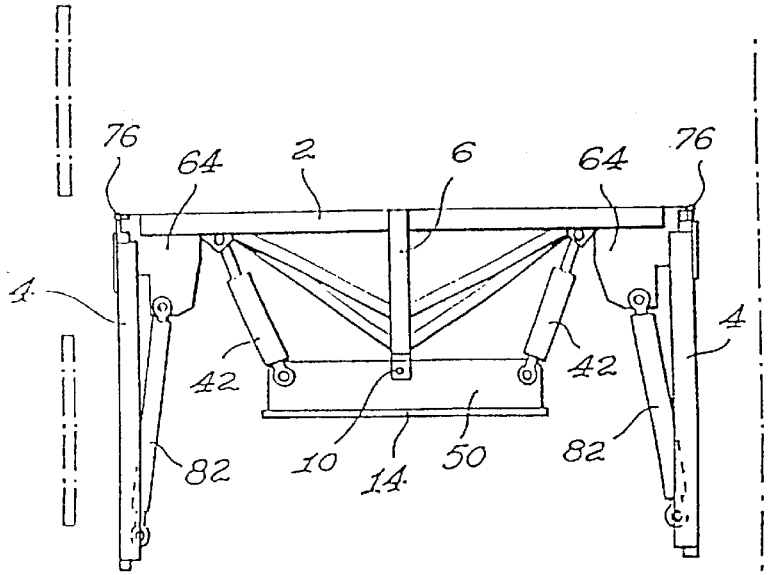
Fig. 13

SNOW BLADE WITH TILTABLE LATERAL PANELS

This applications claims benefit of USC Provisional Appln. No. 60/020,132 filed Jun. 20, 1996.

FIELD OF THE INVENTION

The present invention relates to a snow plow which includes a main blade and at least one lateral wing blade which is hinged to one lateral side end of this main blade so as to take an adjusted inclination forwardly or rearwardly of the main blade.

BACKGROUND OF THE INVENTION

U.S. Pat. No. 4,356,645 dated Nov. 2$^{nd}$, 1982 entitled Variable Wing Plow Blade and mounting structure therefore, inventors Gordon Hiden and Robert D. Mathis describes a central plow blade with two wing blades which are hinged to the ends of the main blade for wing blade angular adjustment forwardly and rearwardly from a position aligned with the main blade. However, the plow described in this patent does not permit a vertical adjustment of the wing blade with respect to the main blade. This patent also describes a mounting structure to attach the blade to the front of a self propelled vehicle. This structure enables motorized adjustment of the blade assembly about roll access full up the blade if not free to automatically follow a transverse inclination of the surface being scraped or plowed. In this patent, each angle of the assembly of the snow blade cannot be automatically changed by a simple raising movement of the blade assembly.

Furthermore, the transverse horizontal inclination of the main blade cannot be varied.

OBJECTS OF THE PRESENT INVENTION

It is a general object of the present invention to provide a snow plow which obviates the above-noted disadvantages. It is a main object of the present invention to provide this snow plow comprising a main blade and a wing blade in which the wing blade can not only be angularly adjusted rearwardly or forwardly of the main blade, but which can also be vertically adjusted so as to plow or scrape in the same pace surfaces at a different levels such as street surface and a sidewalk surface.

Another object of the invention is to provide a snow plow including a main blade and at least one wing blade in which the main blade can be adjustably horizontally inclined as well as a wing blade with respect to the direction of travel of the snow plow.

Another object of the invention is to provide a snow plow of the character described in which the entire wing blade assembly is free to pivot about a longitudinal roll access to automatically follow the transverse inclination of the surface being scraped and plowed.

Another object of the present invention is to provide a snow plow of the character described in which the blades are provided with a striker lip becoming automatically pivoted rearwardly of the blade upon forward movement of the blade respectively.

Another object of the present invention resides in the provision of a snow plow of the character described in which each blade consists of a flat panel and can plow when moving rearwardly as well as forwardly, thus facilitating snow removal for instance of a garage, alley way, and the like.

Another object of the present invention is to provide a snow plow of the character described provided with two side wing blades which can be folded rearwardly at right angles to the main blade so as to comply with prescribed maximum width of road vehicles.

SUMMARY OF THE INVENTION

A snow plow comprising a main blade and a wing blade in end to end relation, a wing blade mounting member, slide means slidably connecting said mounting member to one end of said main blade for up and down sliding movement of said member relative to said main blade, hinge means connecting one of said wing blade to said member about a pivotal axis generally parallel to the direction of sliding movement for pivoting movement of said wing blade relative to said member, first power means carried by said mounting member and acting on said wing blade to effect angular adjustment of said wing blade relative to said main blade about said hinge means, a second power means carried by said main blade and acting on said mounting member to effect said sliding movement of said member and consequently, adjustment of the level of wing blade relative to said main blade.

Preferably, there is further provided a second wing blade, a second wing blade mounting member, a second slide means slidably connecting said second mounting member to the opposite end of said main blade for up and down movement of said second mounting member relative to said main blade, second hinge means connecting one end of said second wing blade to said second member for pivoting movement of said second wing blade relative to said second member, third power means carried by said second member and acting on said second wing blade to effect angular adjustment of said second wing blade relative to said main blade about said second hinge means and fourth power means carried by said main blade and acting on said second second mounting member to effect said sliding movement of said second member and consequently, the adjustment of the level of said second wing blade relative to said main blade; said first, second, third and fourth power means acting independently of each other whereby the level and the angular adjustment of each wing blade relative to said main blade can be adjusted independently of each other.

The main blade and said two wing blades may form flat plates which can take a coplanar relationship in a given angular adjustment of said wing blades.

Each blade could have a bottom edge and could further include for each blade a striker lip substantially coextensive with and hinged to said blade for pivotal movement rearwardly of said blade, and resilient means to bias said lip to a position coplanar with the corresponding said blade.

Advantageously, there would be further provided a supporting structure for supporting said snow plow in front of a vehicle having forward lifting arms comprising a framework means to attach said framework to said arms, a thrust plate forwardly of said frame work horizontal pivot means connecting said thrust plate to said frame for limited rearward pitching movement of said thrust plate relative to said frame work, a mounting plate applied flat against said thrust plate forwardly thereof and pivoted to the latter about a longitudinal roll pivot for a roll movement of said mounting plate relative to said thrust plate, resilient limit means to resiliently limit said roll movement of said mounting plates symmetrically of a central upright position of said mounting plate related to said thrust plate, pusher arms secured to and rearwardly extending from the center portion of said mean blade, vertically spaced vertical pivot means connecting the rear free ends of said pusher arms to said mounting plate, and third power means connected between said main blade and said mounting plate on each side of said pusher arms to adjustably pivot said main blade about said vertical pivot means.

It is envisioned that the main blade and said two wing blades form flat plates which can take a coplanar relationship in a given angular adjustment of said wing blade relative to said main blade and wherein each blade has a bottom edge; and further including for each blade a striker lip substantially coextensive with an hinge to said blade for pivotal movement rearwardly or forwardly of said blade and resilient means to bias said lip to a position coplanar said blade.

Preferably, the snow plow further includes a wing blade tilting means, cooperating with said hinge means for tilting motion of the laterally outward end portion of each said wing blade upwardly or downwardly responsively to road level gradients beneath said wing blade relative to said main blade, said wing blade lateral outer end portion downward tilting motion occurring solely under gravity bias from the wing blade weight itself.

BRIEF DESCRIPTION OF THE DRAWINGS

In the annexed drawings

FIG. 6 is a partial front elevation of one lateral end portion, the blade assembly showing one wing blade in raised position with respect to the main blade;

FIG. 7 is a side elevation at an enlarged scale of the main blade and of the blade supporting structure, and suggesting in phantom lines the rearward play of the striker lip;

FIGS. 10 to 13 inclusive show in top plan view the various angular positions of the main blade and of the wing blades relative to the main blade.

DESCRIPTION OF THE PREFERRED EMBODIMENT

Figure 1:
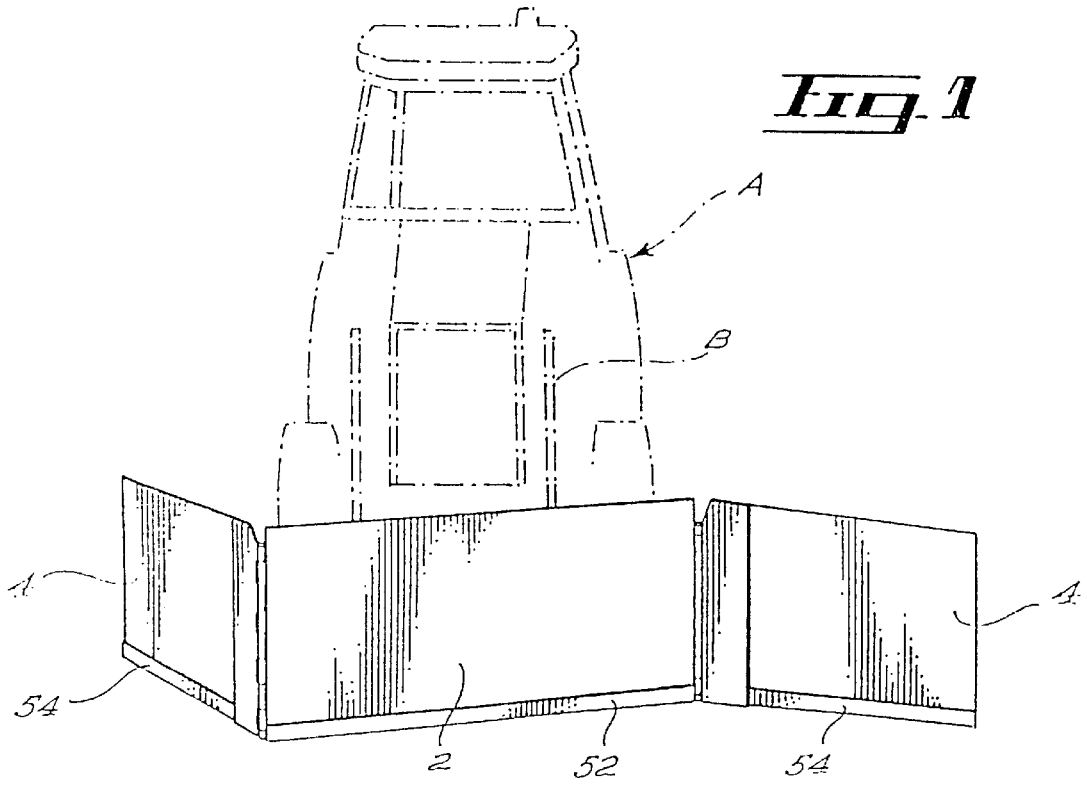
FIG. 1 is a front perspective view of a snow plow mounted in front of a tractor in phantom lines and elevational provided with power operated lifting arms.

In the annexed drawings like reference characters indicate like elements throughout.

Figure 2:
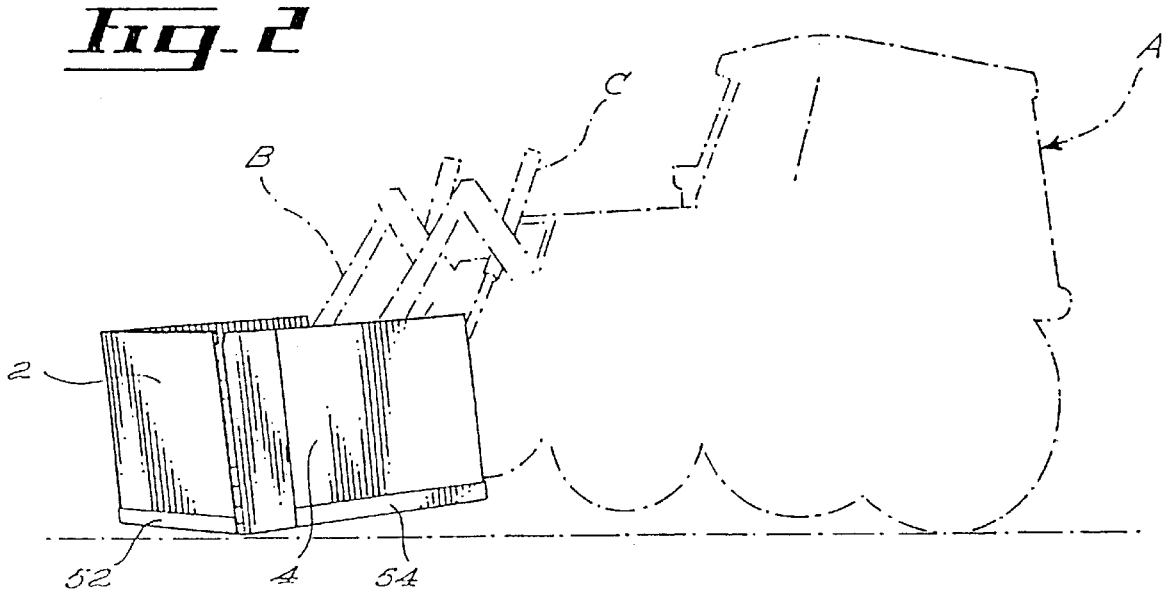
FIG. 2 is a lateral view of the snow plow and of the vehicle shown in phantom lines.
Figure 3:
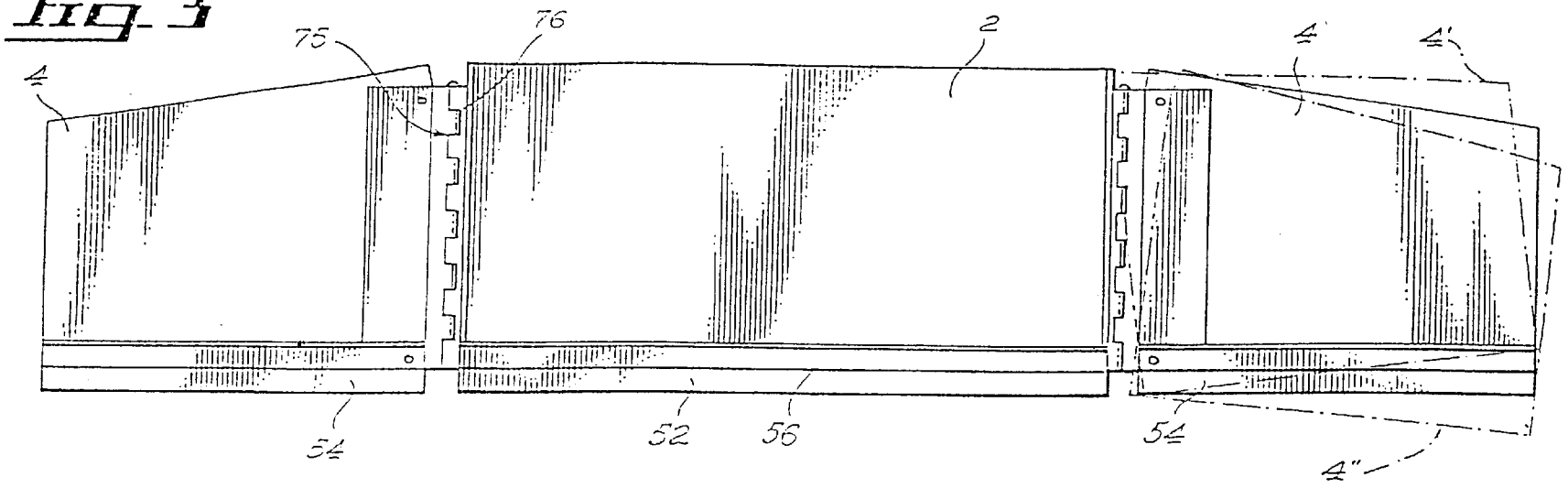
FIGS. 3 and 4 are front and rear elevations respectively of a snow plow assembly without its supporting structure, and suggesting in dotted lines (see FIG. 3) the vertical play of one of the lateral panels relating to the main panel.
Figure 4:
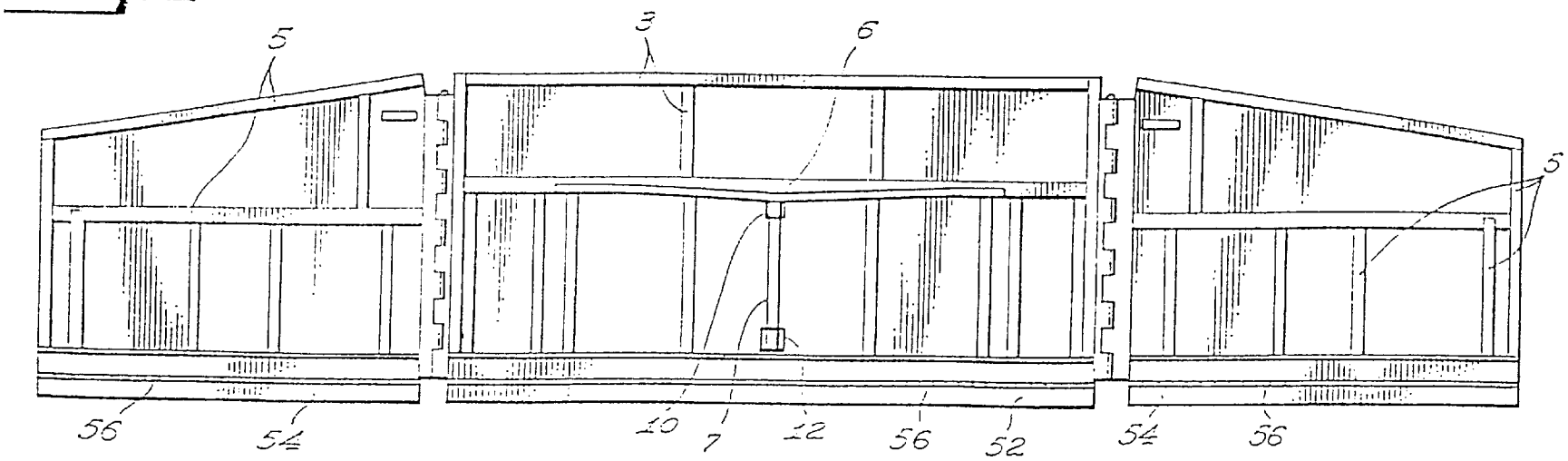
Figure 5:
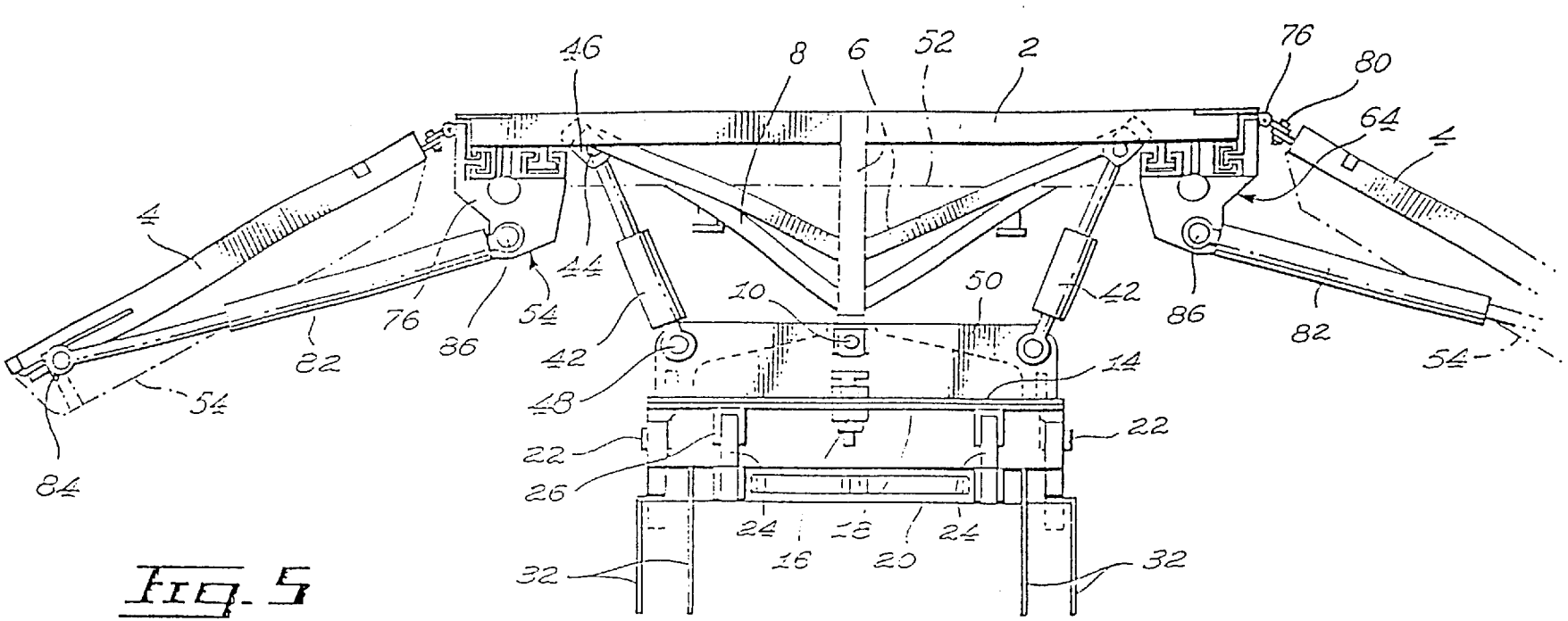
FIG. 5 is a top plan view of the intermediate portion of the snow plow assembly and of its supporting structure with the striker lips shown in phantom lines.
Figure 8:
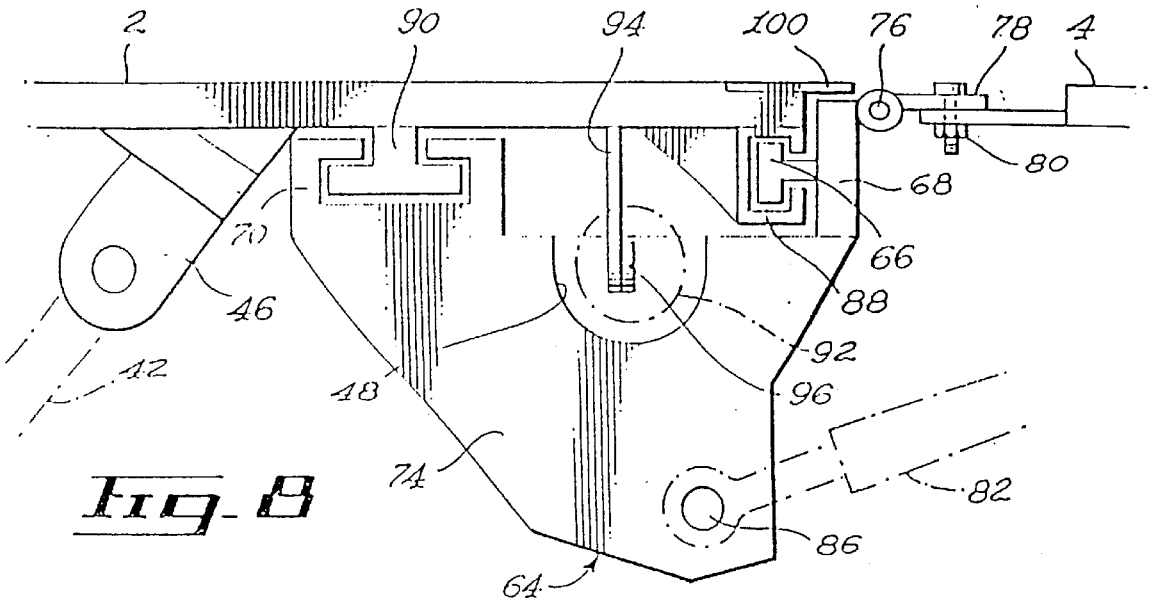
FIG. 8 is an enlarged top plan view of one end of the main blade to which is slidably attached one wing blade mounting member and showing in phantom lines a portion of a wing blade hinged to said wing mounting member together with the wing blade hydraulic ram.

As shown in FIGS. 1, 2 and 3, the snow plow is composed of a main blade 2 and of two wing blades 4 pivoted to the opposite ends of the main blade 2. Each blade 2 and 4 is formed by a flat panel reinforced by a framework 3 forming blade 2 and framework 5 for each of the wing blade as shown in FIG. 4. Referring to FIGS. 5 and 7, an upper pusher arm assembly 6 and a lower pusher arm assembly 8 are secured to the framework 3 of main blade 2 and extend rearwardly of the latter. The rear free ends of the pusher arms are pivotally connected by vertically aligned upper pivot end and lower pivot 12 to a mounting plate 14 which is pivotally attached by a central longitudinal horizontal pivot 16 to the front of a thrust plate 18. Mounting plate 14 is applied flat against thrust plate 18 and pivot 16 forms a roll access whereby mounting plate 14 roll from side to side to a limited extend as it will be described hereinafter. Thrust plate 18 which is vertically disposed is vertically pivoted to its lower edge to a framework 20 by means of aligned horizontal lower pivot 22. A pair of links 24 are pivotally connected above horizontal pins 26 to the top of thrust plate 18. The rear ends of the links 24 are provided with elongated slots 28 through which extends a horizontal pin 30 fixed to the frame work 20. Therefore, thrust plate 18 and consequently, the whole assembly of the blade 2 and the two wing blades 4 are free to pivot rearwardly, upwardly about the transverse pivots 22 to a limited extend as defined by the slots 28. Frame work 20 has two pairs of rearwardly extending brackets 32 provided with upper and lower transversely aligned holes 34 for attachment.

Referring to FIG. 7, it is seen that a tie rod 31 is attached to framework 20 and extends through a hole in thrust plate 18 and is fitted with a rubber block 31*a* abutting the front face of thrust plate 18. This forms a shock absorber which elastically limits the downward forward tilting of plate 18 with respect to frame work 20.

Brackets 32 are pivotally attached in conventional manner to the two pairs of conventional lifting arms B of a vehicle A such as a pay-loader type vehicle which serves to move the snow plow forwardly or rearwardly. The vehicle A is equipped with hydraulic cylinder C to raise the lifting arms B. It will be noted that upon raising frame work 20, the pitch angle thrust plate 18 and consequently of main blade 2 will increase with respect to frame work 20 to a maximum limit as determined by the adjusted position of rubber block 31*a* on tie rod 31 or by pin 30 against the rear end of slot 28. Tiltable mounting plate can pivot about the roll access determined by central longitudinal pivot 16 equally on each side of a centered upward position to a limit determined by the stabilizer springs 36 (see FIG. 7) each of which is mounted between a top abutment plate 38 fixed to tiltable mounting plate 14 and abutment plate 46 to thrust plate 18.

Figure 10:
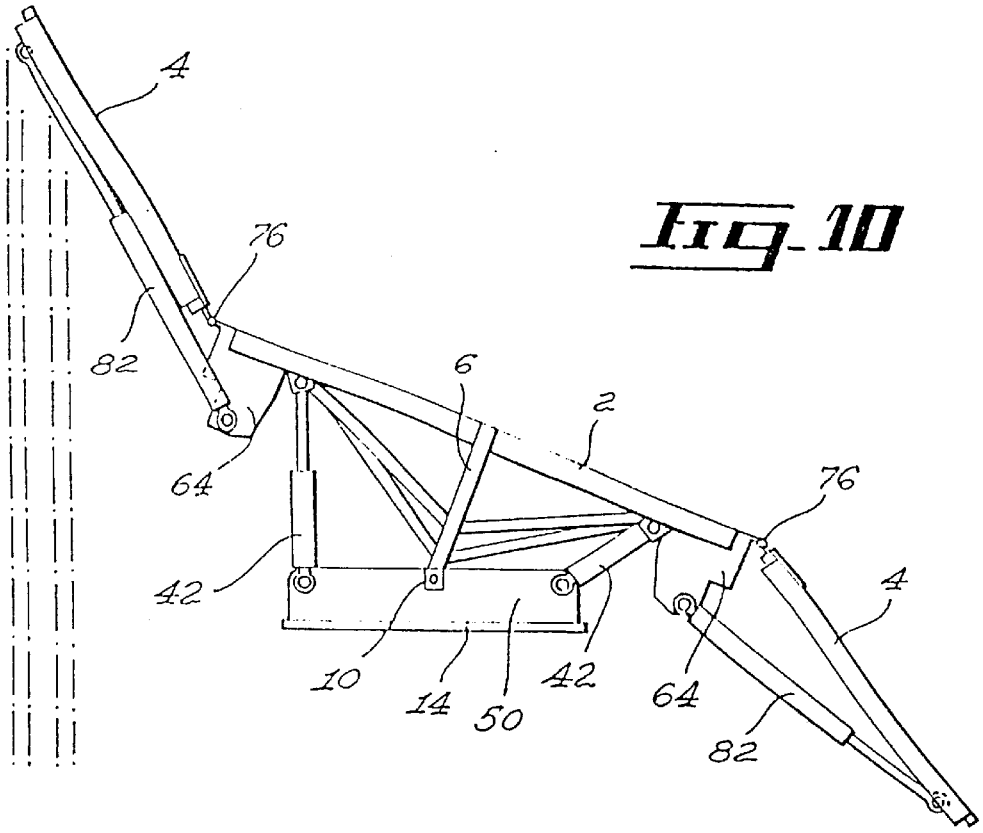
Figure 11:
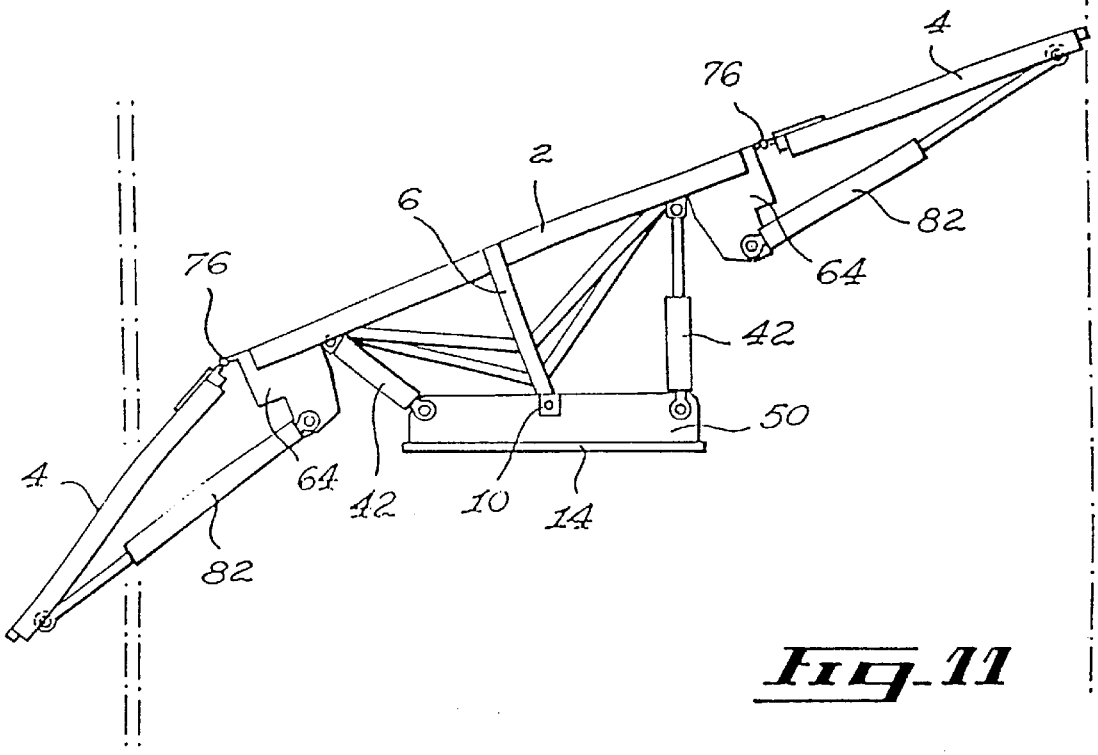

A pair of double acting hydraulic cylinders 42 is mounted on each side of the center vertical pivot 10,12 to horizontally implant the main blade 42 equally on each side of the normal direction of movement of the snow plow as shown in FIGS. 10 and 11. Each hydraulic cylinder 42 is pivotally attached by a pivot 44 to ear 46 fixed to main blade 2 and by pivot 48 to ears 50 from tiltable mounting blade 14.

A striker lip 52 is pivotally carried by the main blade 2 and is pivotable, Striker lip 54 is pivotally carried by each wind blade 4. Striker lips 52 and 54 extend along and are coextensive with the respective blades 2 and 4, and are pivotally connected thereto by means of a piano hinge 56 so that, as shown in FIG. 7, the striker lip 52,54 can pivot rearwardly at 52' in phantom lines when striking an obstacle with the tractor vehicle A moving forwardly but will remain upright when the snow plow A moves rearwardly (the striker lip 52,54 can not pivot forwardly). A coil spring 58 serves to bias the striker lip 52 or 54 to a normal position coplanar with the blade 2 or 4. Spring 58 is held in position by a rod 60 pivoted at its lower end to rearwardly extending ears fixed to striker lip 52 and provided with a slit at its upper end to slidably engage around a locating pin 62 carried by the main blade 2 or wing blade 4.

Figure 9:
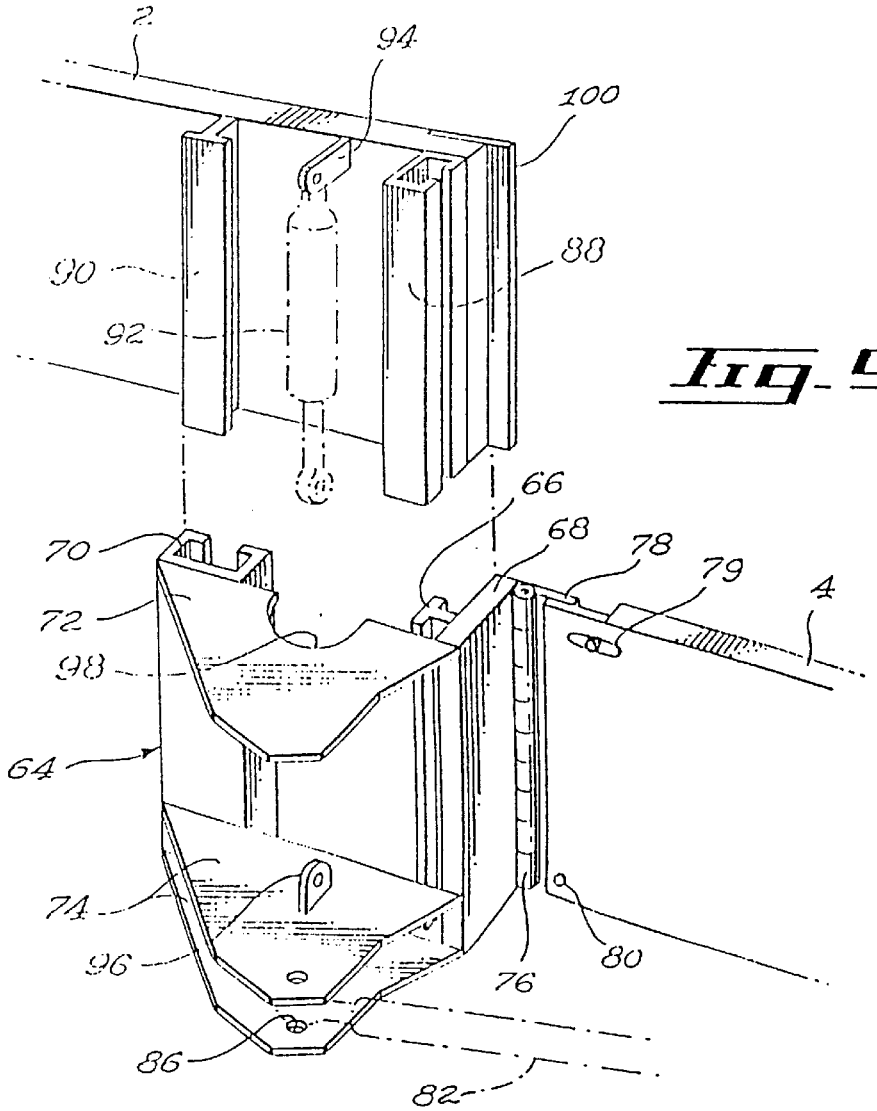
FIG. 9 is a perspective exploded view of the elements shown in FIG. 8.

In accordance with an essential characteristic of the present invention, there is provided that each lateral side end of the main blade 2 has a wing blade mounting member 64 which is mounted behind the main blade for vertical sliding movement with respect to the same but which retain against any horizontal movement relative to the main blade. For this purpose, member 64 includes a vertical male slider 66 fixed to a heavy plate 68 and channel shape female slider 70 which is also vertical. Plate 68 and female slider 70 are transversely rigidly connected by a top link plate 72 and a pair of vertical bottom links 74. As clearly illustrated in FIGS. 3 and 9, each wing blade 4,4 can tilt vertically outwardly, responsively to a road uneveness at the lateral outer end portion of the wing blade. More particularly, each wing blade 4 can tilt upwardly outwardly at 4', to accomodate a raised road portion over the wing blade composed to the main blade 2, or can tilt downwardly outwardly at 4", to accomodate a trough beneath the wing blade 4. It is noted that, although only the right-hand side wing blade 4 has been illustrated in FIG. 3 in its various tilted conditions in phantom lines, it is to be understood that the left hand side wing blade 4 will behave in a similar fashion, since both wing blades have the same features. Upward wing blade tilting motion occurs under upward road surface bias, while downward wing blade tilting motion occurs under gravity forces, namely, simply under the weight of the wing blade.

Such tilting capability of each wing blade 4 is enabled by a first sliding pivot mount assembly 79, including a horizontally extending oblong bore at the upper interior portion of wing blade 4, and a pin extending through the oblong bore, and a second non sliding pivot mount assembly 80, consisting of a pin extending through the lower interior portion of wing blade 4.

A vertical piano hinge 76 has one hinge leaf secured to plate 68 while its other hinge leaf 78 is removably secured to the inner end of each wing blade by the respective pins of pivot assemblies 79,80.

A double acting wing blade inclining hydraulic cylinder 82 is pivotally connected by a pivot 84 to the associated wing blade 4 and by a pivot 86 to the pair of bottom link plates 74 of wing blade mounting member 64. Each lateral side end of main blade 2 is provided with a vertical female slider 88 and male slider 90 respectively slidably receiving male slider 66 and slidably engaging female slide 70 of wing blade mounting member 64. A hydraulic cylinder 92 serves to raise lower wing blade mounting member 64 and consequently the wing blade 4 pivoted to member 64 for adjusting the horizontal level of the wing blade with respect to the main blade. Raising cylinder 92 is pivotally connected at its top end to a top ear 94 fixed to frame work 3 of the back of main blade 2, and is also pivotally connected to a bottom ear 96 upstanding from the upper one of the bottom link plate 74.

Hydraulic cylinder 92 freely extends through a recess 98 made in top link plate 72. A shield plate 100 is edgewisely integrally dependent from each end of main blade 2 forwardly of the front face of plate 68. Preferably, the shield 100 should also extend forwardly of piano hinge 76 to shield the latter against snow or ice and any debris. A conventional hydraulic circuit is provided for the driver of vehicle A to operate the lifting arms B and the hydraulic cylinders 42,82 of the snow plow. The hydraulic cylinders 42 are operated in unison in reverse direction to laterally pivot the main blade about vertical pivot 10,12; however, the remaining hydraulic cylinders 82 and 98 are all independently controlled so that angular value and the horizontal level of any of the wing blades 4 with respect to main blade 2 can be independently adjusted.

As shown in FIG. 6, the offset level of one wing blade 4 with respect to main blade 2 permit to conveniently scrape and plow in one pass a road way and in the adjacent higher level, a sidewalk S. Referring to FIGS. 10 to 13, it will be seen that hydraulic cylinders 42 serve to horizontally incline main blade 2 either to the left or to the right from a transverse position shown in FIG. 13. Hydraulic cylinder 82 adjusts the horizontal inclination of each wing blade 4 forwardly or rearwardly of main blade 2 in accordance with the various requirements of a given snow plowing operation. FIG. 13 also shows that the two wing blades 4 can be rearwardly pivoted to a position at right angle to the main blade 2, so that the snow plow has a minimum width in an operative position to permit travels on fitted streets. It will be noted that the snow plow blades automatically follow the transverse inclination of the surface being plowed since it is free to pivot about the roll access 16 within limits defined by the abutment springs 36. The snow plow blades are preferably flat panels which have been found to be more efficient at slow speed operation in city streets, garage, drive ways and the like.

In accordance with the present invention, it has been found that the particular dynamics of snow removal ahead of the flat upright blades have been improved, when the heavy truck moves forward at low or medium speeds. Indeed, the snow that is pushed forwardly in this fashion will build up in height, contrarily with the forwardly upwardly directed rollers generated with conventional concave blades. Due to this progressive build up in height of the snow collected from ground, without any induced rotational snow motion, a build up of "air pressure" is generated between the ground surface and the accumulated snow thereabove, so that an "air cushion" effect similar to hovercraft concepts is obtained. Such air cushion effect substantially increases the efficiency of operations of the vehicle, since a much lower power output is required to move a given volumic as well as weight quantity of snow, compared to the trucks fitted with concave blades.

I claim:

1. A snow plow comprising a main blade and a wing blade in end to end relation, a wing blade mounting member, slide means slidably connecting said mounting member to one end of said main blade for up and down sliding movement of said mounting member relative to said main blade, hinge means connecting one of said wing blade to said mounting member about a pivotal axis generally parallel to the direction of sliding movement for pivoting movement of said wing blade relative to said mounting member, first power means carried by said mounting member and acting on said wing blade to effect angular adjustment of said wing blade relative to said main blade about said hinge means, a second power means carried by said main blade and acting on said mounting member to effect said sliding movement of said member and consequently, adjustment of the level of wing blade relative to said main blade.

2. A snow plow as defined in claim 1, further including a second wing blade, a second wing blade mounting member, a second slide means slidably connecting said second mounting member to the opposite end of said main blade for up and down movement of said second member relative to said main blade, second hinge means connecting one end of said second wing blade to said second member for pivoting movement of said second wing blade relative to said second member, third power means carried by said second mounting member and acting on said second wing blade to effect angular adjustment of said second wing blade relative to said main blade about said second hinge means and fourth power means carried by said main blade and acting on said second mounting member to effect said sliding movement of said second member and consequently, the adjustment of the level of said second wing blade relative to said main blade; said first, second, third and fourth power means acting independently of each other whereby the level and the angular adjustment of each wing blade relative to said main blade can be adjusted independently of each other.

3. A snow plow as defined in claim 2, wherein said main blade and said wing blades form flat plates which can take a coplanar relationship in a given angular adjustment of said wing blades.

4. A snow plow as defined in claim 3, wherein each blade has a bottom edge and further including for each blade a striker lip substantially coextensive with and hinged to said blade for pivotal movement rearwardly of said blade and resilient means to bias said lip to a position coplanar with the corresponding said blade.

5. A snow plow as defined in claim 2, further including a supporting structure for supporting said snow plow in front of a vehicle having forward lifting arms comprising a framework means to attach said framework to said arms, a thrust plate forward of said framework horizontal pivot means connecting said thrust plate to said frame for limited rearward pitching movement of said thrust plate relative to said framework, a mounting plate applied flat against said thrust plate forwardly thereof and pivoted to the latter about a longitudinal roll pivot for a roll movement of said mounting plate relative to said thrust plate, resilient limit means to resiliently limit said roll movement of said mounting plates symmetrically of a central upright position of said mounting plate relative to said thrust plate, pusher arms secured to and rearwardly extending from the center portion of said main blade, vertically spaced vertical pivot means connecting the rear free ends of said pusher arms to said mounting plate, and third power means connected between said main blade and said mounting plate on each side of said pusher arms to adjustably pivot said main blade about said vertical pivot means.

6. A snow plow as defined in claim 5, wherein said main blade and said two wing blades form flat plates which can take a coplanar relationship in a given angular adjustment of said wing blade relative to said main blade, and wherein each blade has a bottom edge; further including for each blade a striker lip substantially coextensive with and hinged to said blade for pivotal movement rearwardly of said blade, and resilient means to bias said lip to a position coplanar to said blade.

7. A snow plow as defined in claim 1, further including a wing blade tilting means, cooperating with said hinge means for tilting motion of the laterally outward end portion of each said wing blade upwardly or downwardly responsively to road level gradients beneath said wing blade relative to said main blade, said wing blade lateral outer end portion downward tilting motion occurring solely under gravity bias from the wing blade weight itself.

8. A snow plow as defined in claim 3, further including a wing blade tilting means, cooperating with said hinge means for tilting motion of the laterally outward end portion of each said wing blade upwardly or downwardly responsively to road level gradients beneath said wing blade relative to said main blade, said wing blade lateral outer end portion downward tilting motion occurring solely under gravity bias from the wing blade weight itself.

* * * * *